United States Patent [19]

Foote et al.

[11] 3,964,393

[45] June 22, 1976

[54] IGNITER

[75] Inventors: Kenneth R. Foote, China Lake, Calif.; Joseph W. Hanzel, Grenada, Miss.; Warren P. Froehner, China Lake, Calif.

[73] Assignee: The United States of America as represented by the Secretary of the Navy, Washington, D.C.

[22] Filed: June 21, 1974

[21] Appl. No.: 481,624

[52] U.S. Cl. ..... 102/37.6; 102/32; 102/37.8

[51] Int. Cl.[2] ..... F42B 4/22; F42B 4/26

[58] Field of Search ..... 102/37.8, 35, 35.6, 102/37.6, 32

[56] References Cited

UNITED STATES PATENTS 3,712,224 1/1973 Hanzel ..... 102/37.8

3,782,285 1/1974 Froehner ..... 102/37.6

*Primary Examiner*—Charles T. Jordan

*Attorney, Agent, or Firm*—R. S. Sciascia; R. Miller; G. F. Baker

[57] ABSTRACT

An igniter for a bore safe flare comprising a piston member and a cap member designed to cause ignition only after the flare grain has cleared the launcher. Flame from the firing charge cannot reach the flare grain for ignition until separation of cap and piston. The cap member is fixed in the base of the flare grain and carries the ignition mix which projects into a central bore of the piston.

2 Claims, 3 Drawing Figures

IGNITER

CROSS REFERENCE TO RELATED APPLICATIONS

The present invention relates to cartridge flares of a type disclosed in assignee's prior application Ser. No. 289201 filed Sept. 14, 1972, now U.S. Pat. No. 3,782,285 issued Jan. 1, 1974 to Warren P. Froehner.

This application is based upon the same subject matter disclosed in said prior application and the same is hereby incorporated by reference.

BACKGROUND OF THE INVENTION

The present invention relates to a cartridge type flare and particularly to a cartridge flare for aerial delivery from a multiple cartridge dispenser by electric ignition means. The flare must be bore safe and reliable at high altitudes and at super sonic speeds.

Previously disclosed flare cartridge designs were complex and involved many parts and with some portions requiring plural manufacturing steps involving close tolerancing of parts. The prior art flare designs have not, therefore, been suitable for quantity production by modern techniques. According to the present invention a simple and easily manufactured ignition device is provided which assures that the flare candle will not be ignited until it has cleared the dispenser.

DESCRIPTION AND OPERATION

Figure 1:
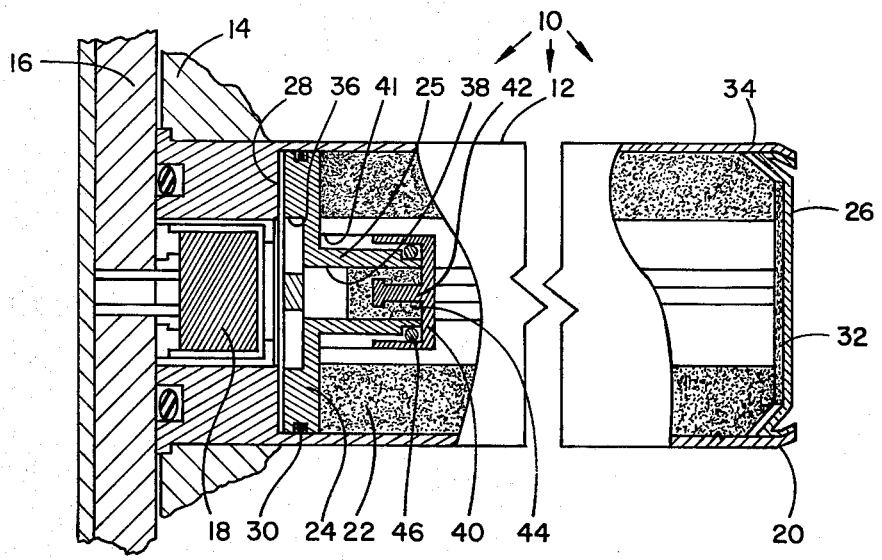
FIG. 1 is a side elevational view partly in section of a flare arrangement according to the invention.

A flare system 10 is depicted in FIG. 1 wherein a flare 12 is contained along with other flares (not shown) in a launcher 14. The flares 12 are held in place in the launcher 14 by a cover member 16 which carries a plurality of impulse cartridges 18.

The flare 12 comprises a case 20 enclosing a flare grain 22 between an expelling piston 24 and an end closure 26. The piston 24 is sealed by a sheet of aluminum foil 28 and is fitted with an obturation seal 30. The aluminum foil 28 protects the parts within the flare casing on the after end while the closure 26 affords protection on the forward end. A spacer 32 of felt or other similar material is advantageously placed under closure 26 to take up tolerance variations. After placement of end closure 26, the case is crimped as shown at 34.

The clearances between the flare grain 22 and the case 20 and the degree of crimp at 34 are such that the flare grain 22 may be easily expelled from the casing through the crimped portion 34. The clearance between the walls of piston 24 and the casing 20, however, are such that the piston 24 will be reliably arrested by the crimp 34 for purposes which will become apparent in the following description of the ignition mechanism.

Figure 3:
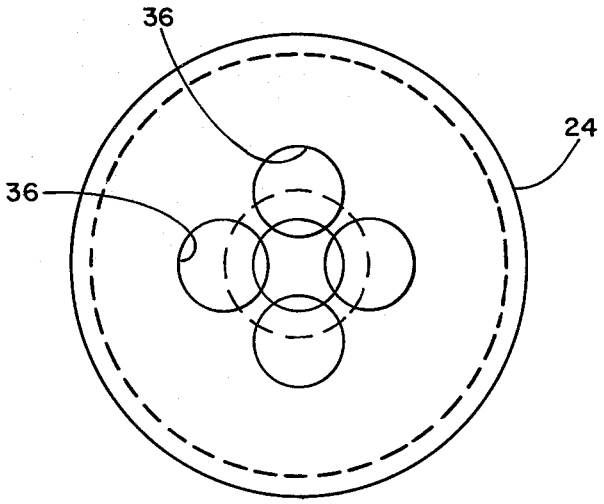
FIG. 3 is an enlarged end view of the piston in FIG. 1.

The ignition means comprises a piston 24 (See FIGS. 1 and 3) having an extension 25 with a central bore 38 on the forward side and four circular openings 36 on the after side communicating in part with said bore 38. The piston 24 is fitted in the casing 20 with close tolerance and carries an obturating O-ring 30 to prevent passage of gases around the piston. The openings 36 are sealed with a sheet 28 of aluminum foil or the like cemented to or otherwise sealingly engaging the after side of piston 24.

Figure 2:
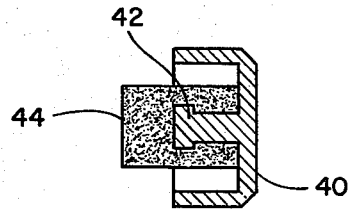
FIG. 2 is an enlarged detail view of the igniter cap of the FIG. 1 device.

A pellet cup 40 (FIGS. 1 and 2) is cemented or otherwise fastened in a cavity 41 in flare grain 22 concentric with the extension 25 of piston 24. Cup 40 is provided with a centrally located flanged post 42 upon which is consolidated a pyrotechnic ignition mix 44. Cup 40 and extension 25 fit together with an O-ring 46 therebetween.

Upon ignition of the expelling charge, gases therefrom immediately impinge upon seal 28 and piston 24. The seal 28 is broken at the openings 36 and burning material from expulsion charge 18 enters chamber 38 to ignite pyrotechnic mix 44.

The pyrotechnic mix 44 is formed to closely fit the bore of extension 25 of piston 24. This arrangement along with the fit of the cup 40 on extension 25 with O-ring 46 therebetween assures that fire will not reach the flare grain until these parts are separated.

The flare grain shown has a convoluted central bore and the cavity 41 is counterbored to a depth of about twice the depth of the flanges of cup 40. Thus, when the parts are separated, flame from the cup will impinge upon the inner convolutions of flare grain 22 for positive ignition.

In other words the expelling charge not only acts to expel the flare grain from the case but also supplies flame to ignite the pyrotechnic mix in pellet 44 for ignition of the flare grain.

The simplicity of design also results in minimum components and allows maximum grain volumn.

What is claimed is:

1. In a bore safe flare system wherein a flare candle is adapted to be ignited only after it is expulsed from a housing by an explosive charge, and including:

a casing;

a flare candle in said casing;

a piston in said casing rearwardly of said flare candle;

ignition means fastened in the after end of said flare candle and extending into a portion of said piston;

said piston and said ignition means being interfitted such that separation thereof must take place before ignition may be accomplished;

and stop means forming part of the forward end of said casing to stop said piston for separation from said ignition means when said flare system is actuated; the improvement comprising:

said ignition means comprising a cup shaped body having a centrally located flanged post with a pyrotechnic ignition mix consolidated on said post to form a solid cylindrical plug;

said piston having a forwardly extending tube with a central bore; and said plug closely fitting within the bore of said tube.

2. The device of claim 1 further including:

said cup having a peripheral flange of finite height;

said flare candle having a bore and a counterbore;

said counterbore having a finite depth equal to about twice the height of said flange; and said cup being bottomed in said counterbore.

* * * * *